US007190894B2

(12) United States Patent
Chamberlain, Jr.

(10) Patent No.: US 7,190,894 B2
(45) Date of Patent: Mar. 13, 2007

(54) ENERGY EFFICIENT ELECTRIC WATER HEATER SYSTEM THAT PROVIDES IMMEDIATE HOT WATER AT A POINT OF USE AND A METHOD THEREFOR

(75) Inventor: Roland J. Chamberlain, Jr., Sierra Vista, AZ (US)

(73) Assignee: MC3 Technology, Inc., Scottsdale, AZ (US)

( * ) Notice: Subject to any disclaimer, the term of this patent is extended or adjusted under 35 U.S.C. 154(b) by 281 days.

(21) Appl. No.: 10/909,652

(22) Filed: Aug. 2, 2004

(65) Prior Publication Data

US 2005/0001047 A1 Jan. 6, 2005

(51) Int. Cl.
*F24H 1/10* (2006.01)

(52) U.S. Cl. ..... 392/490; 392/465; 392/488

(58) Field of Classification Search ..... None
See application file for complete search history.

(56) References Cited

U.S. PATENT DOCUMENTS

| | | | | | |
|---|---|---|---|---|---|
| 3,546,431 | A | * | 12/1970 | Gibbs | 392/503 |
| 5,129,034 | A | * | 7/1992 | Sydenstricker | 392/486 |
| 5,216,743 | A | * | 6/1993 | Seitz | 392/490 |
| 5,408,578 | A | * | 4/1995 | Bolivar | 392/490 |
| 5,559,924 | A | * | 9/1996 | Kadotani et al. | 392/483 |
| 5,740,315 | A | * | 4/1998 | Onishi et al. | 392/489 |

* cited by examiner

*Primary Examiner*—Thor S. Campbell
(74) *Attorney, Agent, or Firm*—Jeffrey D. Moy; Harry M. Weiss; Weiss, Moy & Harris, P.C.

(57) ABSTRACT

A water heater system that will provided immediate hot water to a point of use has a water storage container having an inlet coupled to a water pipe and an outlet coupled to a point of use fixture. A low current heating element is located within the water storage container and is used to immediately heat up and removes contaminants in the water stored and flowing through the water storage container.

13 Claims, 1 Drawing Sheet

(26A)

ENERGY EFFICIENT ELECTRIC WATER HEATER SYSTEM THAT PROVIDES IMMEDIATE HOT WATER AT A POINT OF USE AND A METHOD THEREFOR

BACKGROUND OF THE INVENTION

1. Field of the Invention

This invention relates to plumbing systems and, more specifically, to an improved energy efficient electric water that will provide immediate hot water to the location or locations to which the hot water is to be delivered.

2. Description of the Prior Art

It is generally a standard practice to provide buildings and residential homes and units with hot water plumbing systems to supply bathrooms, kitchens, and the like with hot water. The hot water plumbing system generally has a water heater which will store 20 gallons or more of water. In order to heat the water in the water heater, various types of NiChrome or other metallic heating elements are installed in the water heater. To provide continuous hot water, the water heater typically operates twenty-four hours a day, unless some type of timer is used. This requires copious amounts of energy in order to accomplish this task. This is due to the fact that the wattage of a single heating element can be 2.5 kilowatts or more. A multi-element water heater can range from 9 kilowatts to 40 kilowatts or more of 240V AC power.

Another problem with current water heater systems is that in most present day hot water plumbing systems, the water heater is located a considerable distance from the location or locations to which the hot water is to be delivered. As a result, between periods of use, the previously heated water sits in the pipe between the water heater and the delivery spigot for significant periods of time. During this time, the water becomes cold even if the piping is insulated. Because of this, a considerable quantity of water must be drawn off before the discharged water reaches a desired temperature. Additionally, a substantial interval of time is required before the discharged water reaches the desired temperature. Furthermore, the water that is drawn off is flushed down the drain and wasted, significantly increasing the cost of providing hot water.

Another problem with current hot water plumbing systems is that the water in the water heater is stagnant during the intervals between usage. This results in sediment accumulating in the bottom of the water heater. The sediment causes two problems. First, the sediment may cause bacteria or algae to form in the water heater. The bacteria or algae may cause health problems for those who use hot water from the water heater. Secondly, the sediment decreases the heater efficiency and, unless periodically removed, results in clogging of the system and corrosion of the heater.

Wachenheim, U.S. Pat. No. 5,371,830 is one patent that tries to overcome some of the problems discussed above. Unfortunately, Wechenheim has several problems. First, Wachenheim requires the use of a special tungsten heating element. The heating element is not a standard heating element and is difficult to find and expensive to replace. Second, Wachenheim requires the use of a 240 volt outlet and draws over 60 amps. Thus, Wachenheim is not very energy efficient.

Therefore, a need exists to provide an improved water heater system. The improved water heater will provide immediate hot water to the location or locations to which the hot water is to be delivered. The improved water heater will further remove some of the contaminants in the hot water which is delivered to the location or locations to which the hot water is required.

SUMMARY OF THE INVENTION

In accordance with one embodiment of the present invention, it is an object of the present invention to provide an improved water heater system.

It is another object of the present invention to provide an improved energy efficient water heater system.

It is still another object of the present invention to provide an improved water heater system that will provide immediate hot water to the location or locations to which the hot water is to be delivered.

It is yet another object of the present invention to provide a multi-voltage, low current, energy efficient water heater system that will provide hot water to the location or locations to which the hot water is delivered.

It is still another object of the present invention to provide an improved water heater that will remove some of the contaminants in the hot water which is delivered to the location or locations to which the hot water is to be delivered.

BRIEF DESCRIPTION OF THE PREFERRED EMBODIMENTS

In accordance with one embodiment of the present invention a water heater system that will provide immediate hot water to a point of use is disclosed. The water heater system has a water storage container having an inlet coupled to a input water pipe and an outlet coupled to a point of use fixture. At least one low current heating element is located within the water storage container and is used to immediately heat water stored within and flowing through the water storage container.

In accordance with another embodiment of the present invention, a water heater system that will provide immediate hot water to a point of use is disclosed. The water heater system has a water storage container having an inlet coupled to a inlet water pipe and an outlet coupled to a point of use fixture. A low current heating element is located within the water storage container which heats up and removes contaminants in the water stored within and flows through the water storage container. The low current heating element is a halogen lamp. A waterproof electrical contact is coupled to each end of the halogen lamp. Wires are coupled to the pair of waterproof electrical contacts to couple the low current heating element to a power supply.

The foregoing and other objects, features, and advantages of the invention will be apparent from the following, more particular, description of the preferred embodiments of the invention, as illustrated in the accompanying drawing.

DETAILED DESCRIPTION OF THE PREFERRED EMBODIMENT

Figure 1:
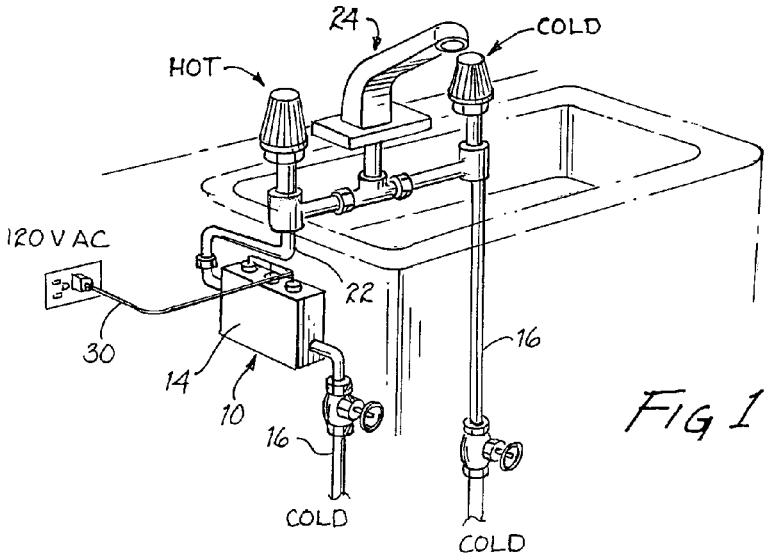
FIG. 1 is an elevated perspective view of the improved water heater system of the present invention installed on a faucet.
Figure 3:
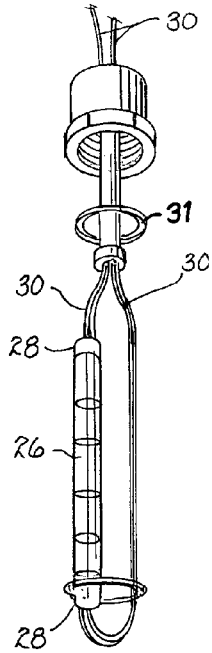
FIG. 3 is a cross-sectional view of the heating element used in the improved water heater of the present invention.
Figure 2:
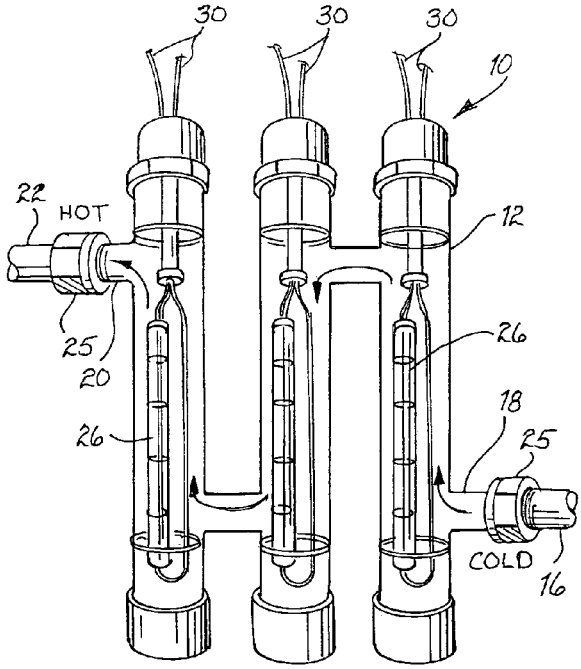
FIG. 2 is a cross-sectional view of the improved water heater system of the present invention.

Referring to FIGS. 1–3, an improved water heater 10 (hereinafter water heater 10) is shown. The water heater 10 will provide immediate hot water to the location or locations to which the hot water is to be delivered. The water heater 10 will further remove some of the contaminants in the hot water which is immediately delivered to the location or locations to which the hot water is to be delivered. Removal of some of the contaminants in the water is accomplished by virtue of the ultraviolet properties of a heating element 26 which is used within the water heater 10.

The water heater 10 is comprised of a water storage container 12. The water storage container 12 is used to store and heat the water which is to be delivered to the point of use. The water storage container 12 is generally of sufficient size to ensure complete immersion of the heating element 26. The water storage container 12 is generally made of a metallic material. The material can be steel, stainless steel, or the like. Any material similar to that currently being used by prior art water heaters may be used. The water storage container 12 may further have insulation 14 coupled to the exterior of the water storage container 12. The insulation 14 is used to contain the heat within the water heater 10.

The water storage container 12 is coupled to a water pipe 16. The water storage container 12 has an inlet opening 18. The inlet opening 18 is coupled to the hot water pipe 16 and is used to allow water from the water pipe 16 to enter the water storage container 12. The inlet opening 18 is generally located at a bottom section of the water storage container 12. The water storage container further has a water outlet opening 20. The water outlet opening 20 is coupled to piping 22. The piping 22 is generally coupled to a fixture 24 which would benefit from an immediate flow of hot water. The water pipe 16 and the piping 22 are generally coupled to the water storage container 12 using water tight fixtures 25 to prevent water leakage.

Located within the water storage container 12 is one or more heating element 26. What is unique about the heating element 26 is that the heating element is a halogen lamp 26A. In general, a quartz halogen lamp is used. However, this should not be seen as to limit the scope of the present invention. The use of the halogen lamp 26A has several benefits. First, halogen lamps 26A are know for generating a large amount of heat in a very short amount of time. Thus, one can quickly heat the water stored and flowing through the water storage container 12. Second, the halogen lamp 26A draws very little power. The halogen lamp 26A can be plug into a standard electrical outlet. Third, by controlling the voltage, power and length of time the halogen lamp 26A is operating, the temperature of the water stored and flowing through the water storage container 12 is variable. By coupling the halogen lamp 26A to an adjustable rheostat/switch, one can easily control the voltage, power and length of operation of the halogen lamp 26A and hence the temperature of the water stored and flowing through the water storage container 12. Fourth, the halogen lamp 26A produces an ultraviolet light. The ultraviolet light will kill bacteria and algae in the water. Thus, the water heater 10 will produce cleaner water. Fifth, the halogen lamp 26A is inexpensive to buy and easy to find in any store.

In order to use a halogen lamp 26A, one must ensure that the halogen lamp 26A is completely immersed in water. This is done in two manners. First, as stated above, the water storage container 12 is of sufficient size to ensure complete immersion of the halogen lamp 26A. Second, the inlet opening 18 and the outlet opening 20 are sized to ensure that the water storage container 12 will always be fully of water. This is done by having the inlet opening 18 sized slightly larger than the outlet opening 20. Thus, more water will always be able to enter the water storage container 12 than exits. Therefore, the water in the water storage container 12 will have a sufficient amount of time in the water container 12 to be heated up.

In order to use the halogen lamp 26A, the halogen lamp 26A must be coupled to a waterproof contact 28. The waterproof contact 28 will prevent the halogen lamp 26A from shorting when the water storage container 12 is full of water. Coupled to the water proof contact 28 are wires 30. The wires are used to provide power to the halogen lamp 26A. In general, a low current power source is used to power the halogen lamp 26A. As may be seen in FIG. 1, the water heater 10 is coupled to a standard low voltage 120 volt power outlet. The halogen lamp 26A will generally only draw a few amps at best depending on the wattage of the halogen lamp 26A. Thus the water heater 10 will have minimal power draw as compared to prior art devices.

Located within the water storage container 12 are spacers 31. The spacers are generally located above and below the halogen lamp 26A. However, this should not be seen as to limit the scope of the present invention. The spacers 31 are used to prevent the heating element 26 from moving and coming in contact with the water storage container 12.

Figure 4:
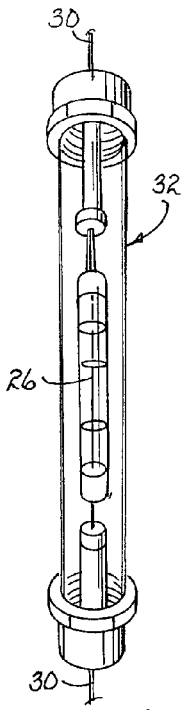
FIG. 4 is a cross-sectional view of another embodiment of the heating element used in the improved water heater system of the present invention.

Referring now to FIG. 4 wherein like numerals and symbols represent like elements, another embodiment of the heating element 26 is shown. In this embodiment the heating element 26 is still comprised of the halogen lamp 26A. However, what is different about the heating element 26 is that the halogen lamp 26A is surrounded by a metal jacket 32. The halogen lamp 26A will heat up the metal jacket 32 which in turn will heat up the water stored in the water storage container 12. As the halogen lamp 26A heats up, the confined space of the metal jacket 32 will not allow the heat generated by the halogen lamp 26A to dissipate. Thus, the metal jacket will begin to heat up and will soon glow from the heat generated and stored within. In accordance with one embodiment of the present invention, the metal jacket 32 is a waterproof metal jacket.

The heating element 26 in FIG. 4 can be used for other purposes besides heating water. For example, the heating element 26 could be used as a heating element 26 to warm a home or business. The heating element 26 could also be used as a heating coil for cooking. The above should not be seen as to limit the scope of the present invention. The heating element 26 disclosed above could be used for other purposes other that those described.

Use

The water heater 10 is coupled to a fixture 24. Water from a water source will travel through the hot water pipe 16 and fill the water storage container 12. The halogen lamp 26A will immediately heat the water. The halogen lamp 26A will further remove some of the contaminates in the water stored and flowing through the water storage container 12. When hot water valve of the fixture 24 is turned on, hot water will immediately be dispensed through the water outlet opening 20 and to the fixture 24. There will be a continuous flow of hot water until the hot water valve of the fixture 24 is turned off.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A water heater system that will provide immediate hot water to a point of use comprising:

a water storage container having an inlet coupled to a water pipe and an outlet coupled to a point of use fixture, wherein the inlet is slightly larger than the outlet to ensure that the water storage container is full of water and the standard halogen light bulb is completely immersed in water;

a low current heating element which is a standard halogen light bulb located within the water storage container which heats up and purifies water stored within and flowing through the water storage container, the standard halogen light bulb coupled to a standard low voltage outlet; and an adjustable switch coupled to the standard halogen light bulb to control a temperature of the water stored in the water storage container.

2. A water heater system in accordance with claim 1 wherein the water storage container stores enough water to immerse the standard halogen light bulb.

3. A water heater system in accordance with claim 1 wherein the water storage container is made of metal.

4. A water heater system in accordance with claim 1 wherein the water storage container is insulated.

5. A water heater system in accordance with claim 1 wherein the halogen lamp removes contaminants in the water stored in and flowing through the water storage container.

6. A water heater system in accordance with claim 1 further comprising:

a waterproof electrical contact coupled to each end of the standard halogen light bulb; and wires coupled to the waterproof electrical contacts to couple the standard halogen light bulb to the standard low voltage outlet.

7. A water heater system in accordance with claim 6 wherein the wires are coupled to a 120 v AC standard power outlet.

8. A water heater system that will provided immediate hot water to a point of use comprising:

a plurality of water storage containers, each water storage container has an inlet that is slightly larger than an outlet to ensure that the water storage container is full of water, a first water storage container having the inlet coupled to a water pipe and a last water storage container having the outlet coupled to a point of use fixture, wherein each water storage container comprises:

a low current heating element located within the water storage container which heats up water stored and flowing through the water storage container and removes contaminants in the water stored and flowing through the water storage container wherein the low current heating element comprises:

at least one halogen lamp;

waterproof electrical contacts coupled to each end of the at least one halogen lamp; and wires coupled to the waterproof electrical contacts to couple the low current heating element to a to a standard low voltage outlet.

9. A water heater system in accordance with claim 8 wherein the water storage container stores enough water to immerse the at least one halogen lamp.

10. A water heater system in accordance with claim 8 wherein the water storage container is made of metal.

11. A water heater system in accordance with claim 10 wherein the water storage container is insulated.

12. A water heater system in accordance with claim 8 wherein the low current heating element is coupled to an adjustable switch to control a temperature of the water stored in the water storage container.

13. A water heater system that will provide immediate hot water to a point of use comprising:

a water storage container having an inlet coupled to a water pipe and an outlet coupled to a point of use fixture, wherein the inlet is slightly larger than the outlet so that water remains in the water storage container during use;

a low current heating element which is a standard halogen light bulb located within the water storage container which heats up and purifies water stored within and flowing through the water storage container, the standard halogen light bulb coupled to a standard low voltage outlet; and an adjustable switch coupled to the standard halogen light bulb to control a temperature of the water stored in the water storage container.

* * * * *